US007483656B2

(12) United States Patent
Park

(10) Patent No.: US 7,483,656 B2
(45) Date of Patent: Jan. 27, 2009

(54) DEVELOPER CONTAINER AND DEVELOPER SUPPLY DEVICE AND IMAGE FORMING APPARATUS INCLUDING THE DEVELOPING CONTAINER

(75) Inventor: Dong-hoon Park, Osan-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 202 days.

(21) Appl. No.: 11/484,777

(22) Filed: Jul. 12, 2006

(65) Prior Publication Data

US 2007/0048027 A1 Mar. 1, 2007

(30) Foreign Application Priority Data

Aug. 29, 2005 (KR) ..... 10-2005-0079587

(51) Int. Cl.
*G03G 15/08* (2006.01)

(52) U.S. Cl. ..... 399/258; 399/260; 399/262; 399/263

(58) Field of Classification Search ..... 222/DIG. 1; 399/119, 254–256, 258, 260, 262–263
See application file for complete search history.

(56) References Cited

FOREIGN PATENT DOCUMENTS

| | | |
|---|---|---|
| JP | 1-62560 | 4/1989 |
| JP | 05-088545 | 4/1993 |
| JP | 10-247011 | 9/1998 |
| JP | 11-109738 | 4/1999 |
| JP | 2001-201930 | 7/2001 |
| KR | 1998-042400 | 8/1998 |
| KR | 1998-070562 | 10/1998 |

*Primary Examiner*—Hoang Ngo
(74) *Attorney, Agent, or Firm*—Roylance, Abrams, Berdo & Goodman, L.L.P.

(57) ABSTRACT

A developer container for a developer supply device and an image forming apparatus include: a container main body which contains developer therein and is provided with at least one developer outlet formed at one side thereof. A shutter unit is rotatably installed in the container main body to open the developer outlet intermittently when being rotated. A developer supply device and an image forming apparatus are provided with the developer container.

35 Claims, 4 Drawing Sheets

DEVELOPER CONTAINER AND DEVELOPER SUPPLY DEVICE AND IMAGE FORMING APPARATUS INCLUDING THE DEVELOPING CONTAINER

CROSS-REFERENCE TO RELATED APPLICATION

This application claims benefit under 35 U.S.C. §119(a) of Korean Patent Application No. 2005-79587, filed Aug. 29, 2005 in the Korean Intellectual Property Office, which is hereby incorporated by reference in its entirety.

BACKGROUND OF THE INVENTION

1. Field of the Invention

The present invention relates to an image forming apparatus. More particularly, the invention relates to a developer container storing a developer therein, a developer supply device and an image forming apparatus.

2. Description of the Related Art

In general, an image forming apparatus, such as a laser beam printer, a LED (light emitting diode) printer, a digital copier, a plain paper fax machine or the like, functions to print visible images on paper, or other printing medium, by transforming image signals.

The image forming apparatus includes a developing device, a laser scanning device, a fusing device and the like. The developing device has a developing device main body, an image receptor, such as a photoconductive drum, installed in the developing device main body and a developing roller supplying developer, such as developer, to the image receptor.

An electrostatic image is formed on a surface of the image receptor by beams irradiated from the laser scanning device. Then, the developing roller supplies the developer from the main body to an electrostatic image area to develop the electrostatic image.

In the configuration described above, the life span of the developing device is spent by the time the print number thereof reaches a predetermined value of the photoconductive drum. The developing device whose life span has been completed is usually replaced by a new one. Therefore, the amount of the developer stored in the developing device main body is usually determined based on the life span of the photoconductive drum.

However, as life spans of parts, such as the photoconductive drum, the developing roller and the like, become longer, the amount of the developer stored in the developing device main body should be increased. Therefore, a new developer supply device was recently developed. In such the developer supply device, a developing device main body with a long life span is installed in the image forming apparatus and the developer is supplied thereto by employing a replaceable developer container.

The developer container is usually provided with a tubular container main body in which the developer is contained, and an agitator installed inside the container main body. A developer outlet is formed at one side of the container main body having a removable film or a shutter.

For example, in a case where the developer outlet is closed by the film, before the developer container is installed in the image forming apparatus, the film is removed to open the developer outlet. In such a condition, the developer container is installed in the image forming apparatus, so the developer outlet is connected to a developer inlet of the developing device main body. Therefore, the developer in the developer container can be supplied to the developing device main body by the rotation of the agitator.

However, in a case of such the developer container, there is a drawback in that the developer outlet of the developer container is always kept open after the developer container is installed in the image forming apparatus, and the developer continues to move toward the developer inlet by the rotation of the agitator. Where the developer in the developing device is not consumed as rapidly as it is supplied thereto, the developer is pressed and accumulated at the developer inlet to form developer lumps. In a serious case, the developer inlet may be blocked or clogged by the developer lumps.

SUMMARY OF THE INVENTION

The present invention has been developed in order to solve the above and other problems associated with the related art. A feature of the present invention is to provide a developer container having an improved configuration to be capable of supplying developer intermittently. The invention is also directed to a developer supply device and an image forming apparatus including the developer container of the invention.

To achieve a feature of the present invention, a developer container is provided, comprising: a container main body containing developer therein and having at least one developer outlet; and a shutter unit rotatably installed in the container main body and to open the developer outlet intermittently when being rotated.

Preferably, the container main body comprises an outer circumferential wall in which the developer outlet is formed; a first side wall; and a second side wall, wherein the first and the second side wall close both ends of the outer circumferential wall.

Preferably, the shutter unit may comprise a shutter member which is rotatably installed in the container main body and provided with at least one opening that is matched with the developer outlet to open intermittently when the shutter member is rotated; and a rotatable member installed in the container main body to rotate the shutter member.

Preferably, the shutter member may be shaped into a ring with a width greater than that of the developer outlet.

Preferably, the shutter member is provided with a linkage protrusion protrudingly formed on an inner circumferential surface thereof, the linkage protrusion being engaged with the rotatable member to receive a rotational force therefrom.

Preferably, the linkage protrusion is formed in one body with the shutter member by cutting and bending the shutter member. The linkage protrusion may be formed adjacent to the opening of the shutter member.

Preferably, the rotatable member is rotatably connected to both ends of the container main body at both end portions thereof, and is provided with a bent portion formed in a center portion thereof. The bent portion is brought into contact with and linked to the shutter member to operate the shutter member.

Preferably, the developer container further includes a drive gear provided on one side surface of the container main body. The drive gear is connected to the rotatable member and receiving a force from an external force source.

Preferably, the developer container further includes a sealing member for preventing the developer from being introduced between the container main body and the shutter member.

Preferably, the sealing member is made of a sponge material and is disposed between an inner circumferential surface of the container main body and an outer circumferential surface of the shutter member.

Preferably, the rotatable member has an agitator rotatably installed in the container main body to agitate the developer and link to the shutter member to operate the shutter member.

In order to achieve a feature of the present invention, a developer supply device is provided comprising: a developing cartridge installed in an image forming apparatus main body and provided with an image receptor installed therein and a developer inlet formed therein; and a developer container installed in the image forming apparatus main body and provided with a developer outlet corresponding to the developer inlet, the developer container having an assembly to intermittently supply the developer by intermittently opening the developer outlet.

In order to achieve a feature of the present invention, an image forming apparatus is provided comprising: an image forming apparatus main body; a developing cartridge installed in the image forming apparatus main body and provided with an image receptor installed therein and a developer inlet formed therein; a transfer roller rotating in contact with the image receptor to transfer an image formed on the image receptor to a printing medium; and a developer container installed in the image forming apparatus main body and provided with a developer outlet corresponding to the developer inlet, the developer container intermittently supplying the developer by intermittently opening the developer outlet.

These and other aspects of the invention will become apparent from the following detailed description of the invention which taken in conjunction with the annexed drawings disclose various embodiments of the invention.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

Certain embodiments of the present invention will be described in greater detail with reference to the accompanying drawings. Further, it should be noted that in the description of the present invention, if detailed descriptions of related disclosed art or configuration are determined to unnecessarily make the subject matter of the present invention obscure, they will be omitted.

Figure 1:
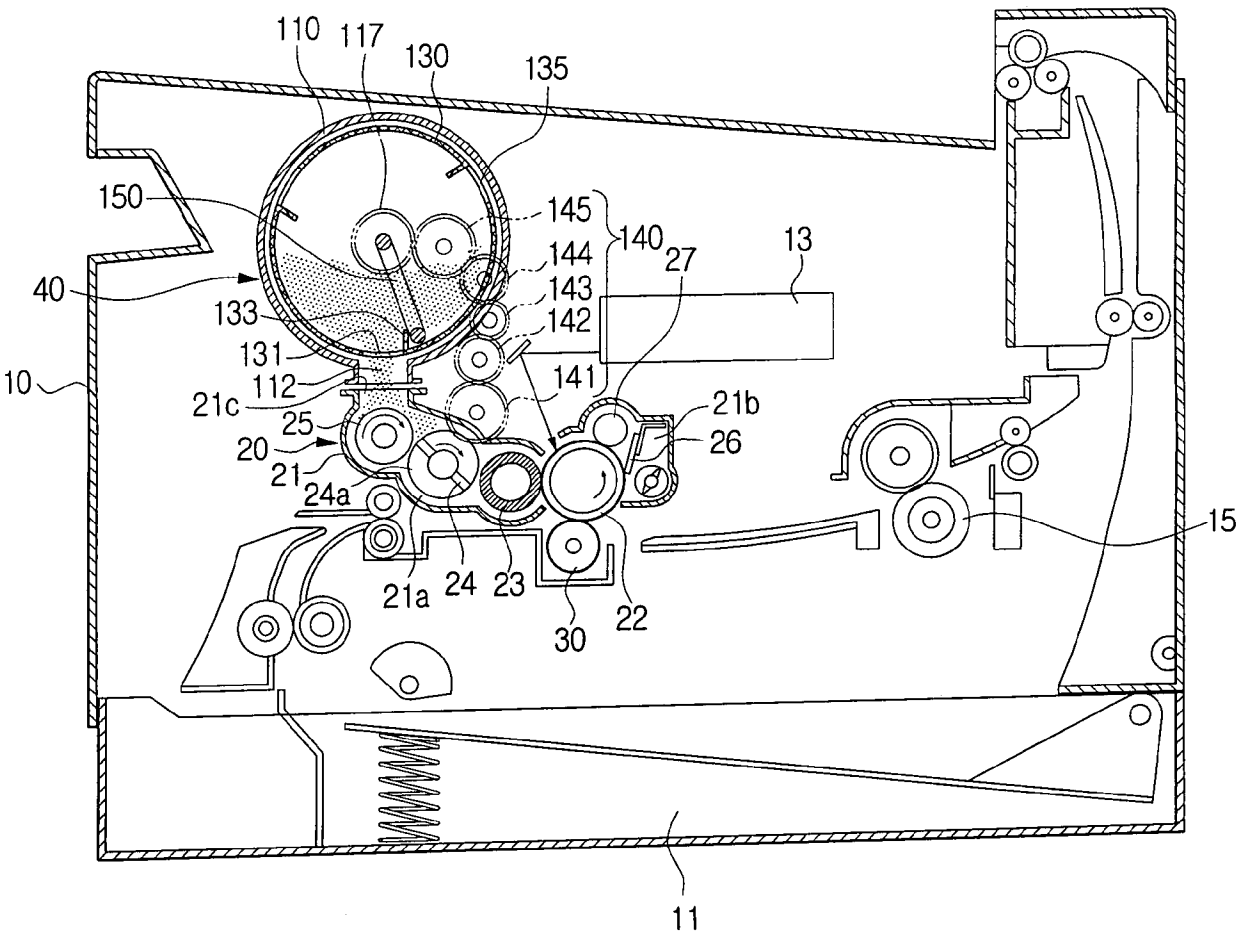
FIG. 1 is a schematic diagram showing a configuration of an image forming apparatus in accordance with an embodiment of the present invention.

Referring to FIG. 1, an image forming apparatus in accordance with an embodiment of the present invention includes an image forming apparatus main body 10, a developing cartridge 20 installed in the image forming apparatus main body 10, a transfer roller 30 installed to be rotatable in contact with an image receptor 22 of the developing cartridge 20 and a developer container 40 for supplying developer to the developing cartridge 20.

A paper supply part 11 is provided for supplying a printing medium between the image receptor 22 and the transfer roller 30. A laser scanning unit 13 and a fuser unit 15 are included in the image forming apparatus main body 10.

The laser scanning unit 13 irradiates laser beams to the image receptor 22 to form electrostatic images thereon.

The fuser unit 15 applies heat and pressure to the printing medium passing through the image receptor 22 and the transfer roller 30, to fuse developer images onto the printing medium. As the laser scanning unit 13 and the fuser unit 15 are known technologies, the detailed descriptions thereof will be omitted.

The transfer roller 30 is rotated in contact with the image receptor 22, allowing the images formed on the image receptor 22 to be transferred onto the printing medium passing through between the transfer roller 30 and the image receptor 22.

The developing cartridge 20 has a cartridge main body 21. The image receptor 22, the developing roller 23, an agitator 24, a developer conveying member 25, a cleaning blade 26 and a charged roller 27 are mounted within the main body 21.

The cartridge main body 21 can be divided into a first chamber 21*a* and second chamber 21*b* by the image receptor 22 positioned therebetween. New developer is supplied to and stored in the first chamber 21*a*. The developing roller 23, the agitator 24 and the developer conveying member 25 are movable and sequentially mounted in the first chamber 21*a*. A developer inlet 21*c* is provided to allow a supply of the new developer into the first chamber 21*a*. The developer conveying member 25 is provided adjacent the developer inlet 21*c*. The agitator 24 is rotated to agitate the developer that is introduced into the first chamber 21*a*. The developing roller 23 supplies the developer to the image receptor 22, thus developing the electrostatic image formed thereon. Inside the second chamber 21*b*, the cleaning blade 26 and the charged roller 27 are mounted. The cleaning blade 26, which cleans residual developer after transferring toner from the image receptor 22 to the printing medium, is in contact with the image receptor 22. Therefore, the second chamber 21*b* can be used as a waste developer storing chamber. Further, the waste developer stored in the second chamber 21*b* can be collected in a given waste developer container (not shown) by a waste developer conveying device (not shown).

The charged roller 27 is for charging a surface of the cleaned image receptor 22 with a predetermined charge.

As the developing cartridge 20 with the configuration described above can be readily understood by those skilled in this field from developing technologies using laser beam printers, no further description thereof will be provided in this specification.

Figure 2:
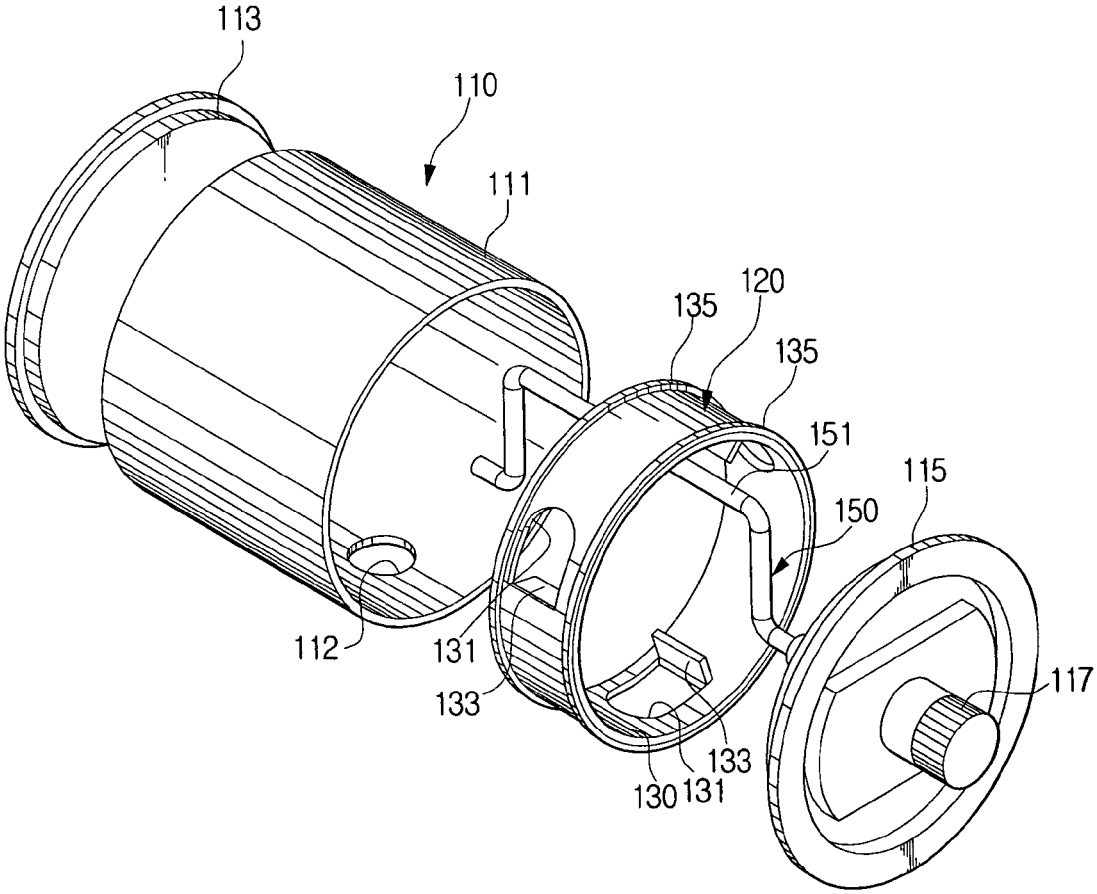
FIG. 2 illustrates a perspective exploded view of a developer container of the image forming apparatus shown in FIG. 1.

The developer container 40 is for supplying the developer intermittently to the developing cartridge 20. As shown in FIG. 2, the developer container 40 includes a container main body 110 with a developer outlet 112 formed therein and a shutter unit 120 rotatably installed inside the container main body 110 to open the developer outlet 112 intermittently.

The container main body 110 has a shape of a tube and contains the developer therein. The container main body 110 has a cylindrical or tubular outer circumferential wall 111, a first and a second end side wall 113, 115 hermetically coupled to both ends of the outer circumferential wall 111. The developer outlet 112 is formed in the outer cylindrical wall for discharging the developer contained in the container main body 110. The developer outlet 112 is formed to cooperate with an corresponding to the developer inlet 21*c* to form a developer conveying path. The developer outlet 112 is kept closed by a removable film before the developer container 40 is used by a user. Alternatively, the outlet 112 can have a structure where the developer outlet 112 is closed by a separate cover instead of the film and where interference of the main body 10 removes the separate cover to open the developer outlet 112 when the container main body 110 is installed into the image forming apparatus main body 10. The first and the second end side wall 113, 115 are coupled to the opposite ends of the outer circumferential wall 111 to hermetically close the container main body. The first and the second end side wall 113, 115 can be press fitted into the both ends of the outer circumferential wall 111 or coupled thereto by a bonding method. A drive gear 117 is provided on the second side wall 115, which is rotated by an external force transferred thereto via the power transmission unit 140 described later. The drive gear 117 is connected to a rotatable member 150 positioned within the container main body 110.

Referring to FIG. 2, The shutter unit 120 has a shutter member 130 rotatably mounted inside the container main body 110. In the embodiment shown, the shutter member 130 is mounted on the rotatable member 150 for rotating the shutter member 130 with respect to the container main body 110. The shutter member 130 has a cylindrical shape with a predetermined width, and is positioned to be in contact with an inner circumferential surface of the container main body 110 and rotated by the external force through the rotatable member 150. The shutter member 130 includes a plurality of openings 131 formed in the side thereof at a regular interval. The openings 131 are located to open the developer outlet 112 intermittently when the shutter member is rotated. The openings 131 preferably have a dimension greater than the dimension of the developer outlet 112. The shutter member 130 is provided with a linkage protrusion 133 extending radially inwardly from an inner circumferential surface of the shutter member to receive a driving force from the rotatable member 150. The linkage protrusion 133 is integrally formed with the shutter member 130 by cutting a U-shaped tab and bending the tab portion inwardly to form the opening 131. A plurality of linkage protrusions 133 can be provided to push and move the developer in the container main body 110 toward the developer outlet 112 when shutter member 130 is rotated. The linkage protrusion 133 also functions to agitate the developer.

When the shutter member 130 with the configuration described above is rotated, the openings 131 are aligned intermittently with the developer outlet 112 intermittently, so that the developer in the container main body 110 is intermittently supplied to the developing cartridge 20 through the developer outlet 112.

Preferably, the shutter member 130 is provided with sealing members 135 to prevent the developer from passing between the shutter member 130 and the inner circumferential surface of the container main body 110. The sealing members 135 are made of, for example, sponge or sponge-like material. The sealing members 135 are attached around an outer circumferential surface of the shutter member 130 by an adhesive material. In the embodiment shown in FIG. 2, sealing members 135 are annular ring seals attached to the outer surface and at the axial ends of the shutter member 130. As shown, two sealing members 135 are positioned on opposite sides of the openings 131. Therefore, the developer is moved to the developer outlet 112 only through the opening 131. The sealing members 135 prevent the developer from being introduced between the shutter member 130 and the inner circumferential surface of the container main body 110. Preferably, the shutter member 130 is formed from an elastic thin plate.

The rotatable member 150 is rotatably mounted inside the container main body 110. In one embodiment, the opposite ends of the rotatable member 150 are rotatably supported by the first and the second side wall 113, 115. One end of the rotatable member 150 is coaxially connected to the drive gear 117 to be rotatable in unison therewith. Therefore, when the drive gear 117 is rotated, the rotatable member 150 is subjected to a follower force to rotate together with the drive gear 117. The rotatable member 150 is provided with a bent portion 151 formed into a predetermined shape shown in FIG. 2. In the embodiment shown, the bent portion 151 has a U-shape with a dimension to be adjacent the inner circumferential surface of the container main body 110. When the rotatable member 150 is rotated, the bent portion 151 is brought in contact with the linkage protrusion 133 of the shutter member 130 to mechanically operate and rotate the shutter member 130. The bent portion 151 has an axial length greater than the axial length of the shutter member 130, so it can serve to agitate the developer in the container main body 110 as the rotatable member is rotated.

The rotatable member 150 is rotated by an external force. Preferably, the rotational force is supplied with the force from the developing cartridge 20 through a power transmission unit 140 shown in FIG. 1. The power transmission unit 140 has an agitator gear 24*a* coaxially connected to the agitator 24 of the developing cartridge 20, and a plurality of connection gears 141, 142, 143, 144, 145. The gear 145 is operatively connected to the drive gear 117.

As an alternative to the aforementioned configuration where the force is transmitted from the agitator 24 to the developer container 40, the force is transmitted from either the image receptor 22 or the developing roller 23 to the developer container 40. Alternatively, the rotatable member 150 can be directly rotated by a separate driving source, such as a separate motor.

Preferably, the rotatable member 150 is provided with a separate agitator for agitating the developer in the developer container 40. In such an arrangement, the agitator can be, for example, agitating blades (not shown) or the like.

In accordance with the image forming apparatus with the configuration described above, the developer container 40 with the developer outlet 112 opened is mounted in the image forming apparatus main body 10, as shown in FIG. 1. Then, the developer outlet 112 is connected to the developer inlet 21*c*, and the drive gear 117 is engaged with the power transmission unit 140 to receive the rotational force from the agitator 24 through the power transmission unit 140.

When installed, the image forming apparatus is activated to commence the printing process. The developing roller 23 supplies the developer to the image receptor 22 to develop images, thus consuming the developer in the developing cartridge 20.

At this time, the rotatable member 150 receiving the rotational force from the agitator 24 is rotated at a predetermined speed. The rotating rotatable member 150 interferes with and engages the linkage protrusion 133 of the shutter member 130 to cause the shutter member to rotate together. As shown in FIG. 1, the opening 131 of the shutter member 130 is aligned with the developer outlet 112 of the developer container 40 while the shutter member 130 rotates so that the developer in the developer container 40 flows to the developing cartridge 20.

Figure 3:
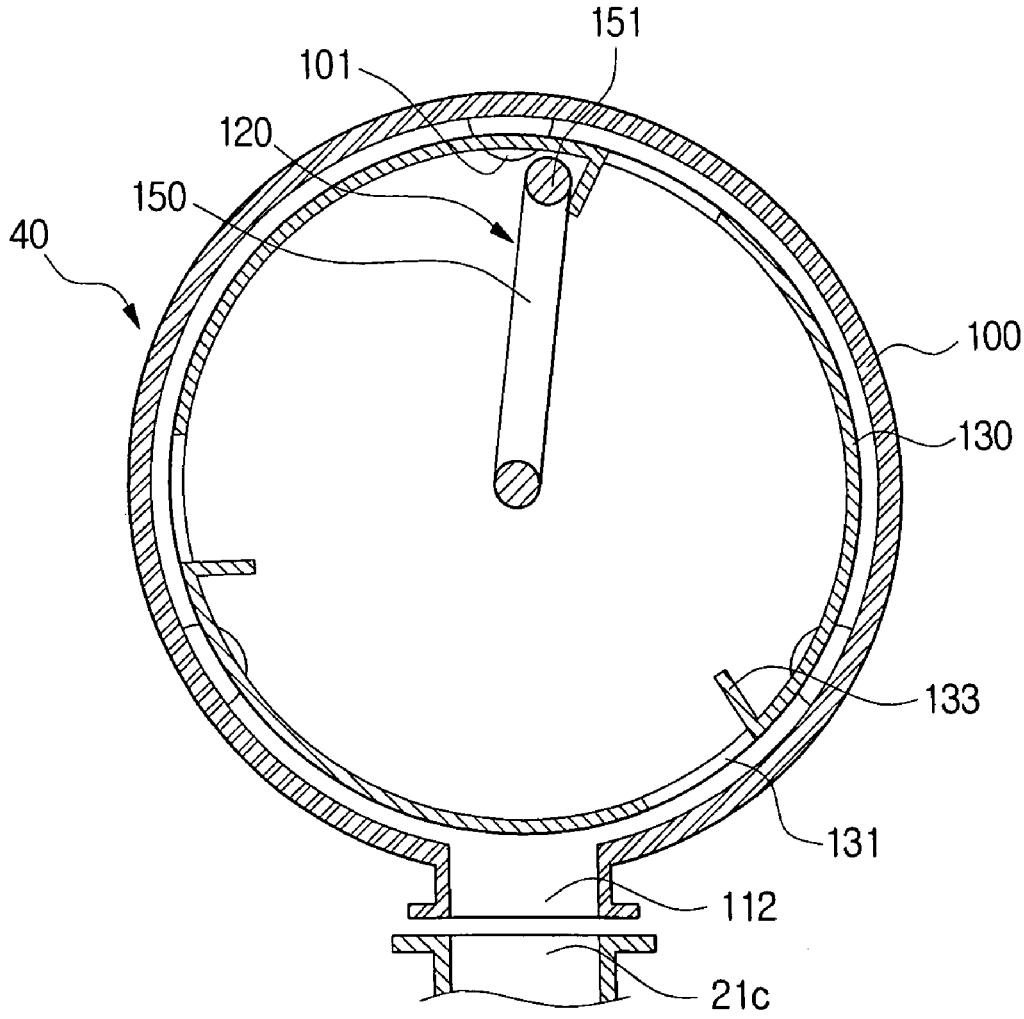
FIG. 3 depicts a cross-sectional view of the developer container shown in FIG. 2 and showing the position of the components.

As shown in FIG. 3, the shutter member 130 is then rotated further by a predetermined angle, and the developer outlet 112 is closed by the shutter member 130. With each rotation of the shutter member 130, the developer outlet 112 is opened intermittently by the number of the openings 131 to supply the developer into the developer inlet 21*c*. At this time, the linkage protrusion 133 serves to push the developer into the developer outlet 112, so the developer can be discharged efficiently when the developer outlet 112 is opened.

As described above, by opening the developer outlet 112 intermittently, the developer can be supplied to the developing cartridge 20 based on the consumption amount of the developer therein. Therefore, it is possible to solve the problem of a blockage of a passage of the developer due to accumulation or piling-up of the developer at the developer inlet 21*c* of the developing cartridge 20.

Furthermore, when the developer is supplied from the developer container 40 to the developing cartridge 20, the developer supply amount can be controlled through an appropriate design of a rotation speed of the rotatable member 150, sizes of the developer outlet 112 and the number and size of the openings 131.

Figure 4:
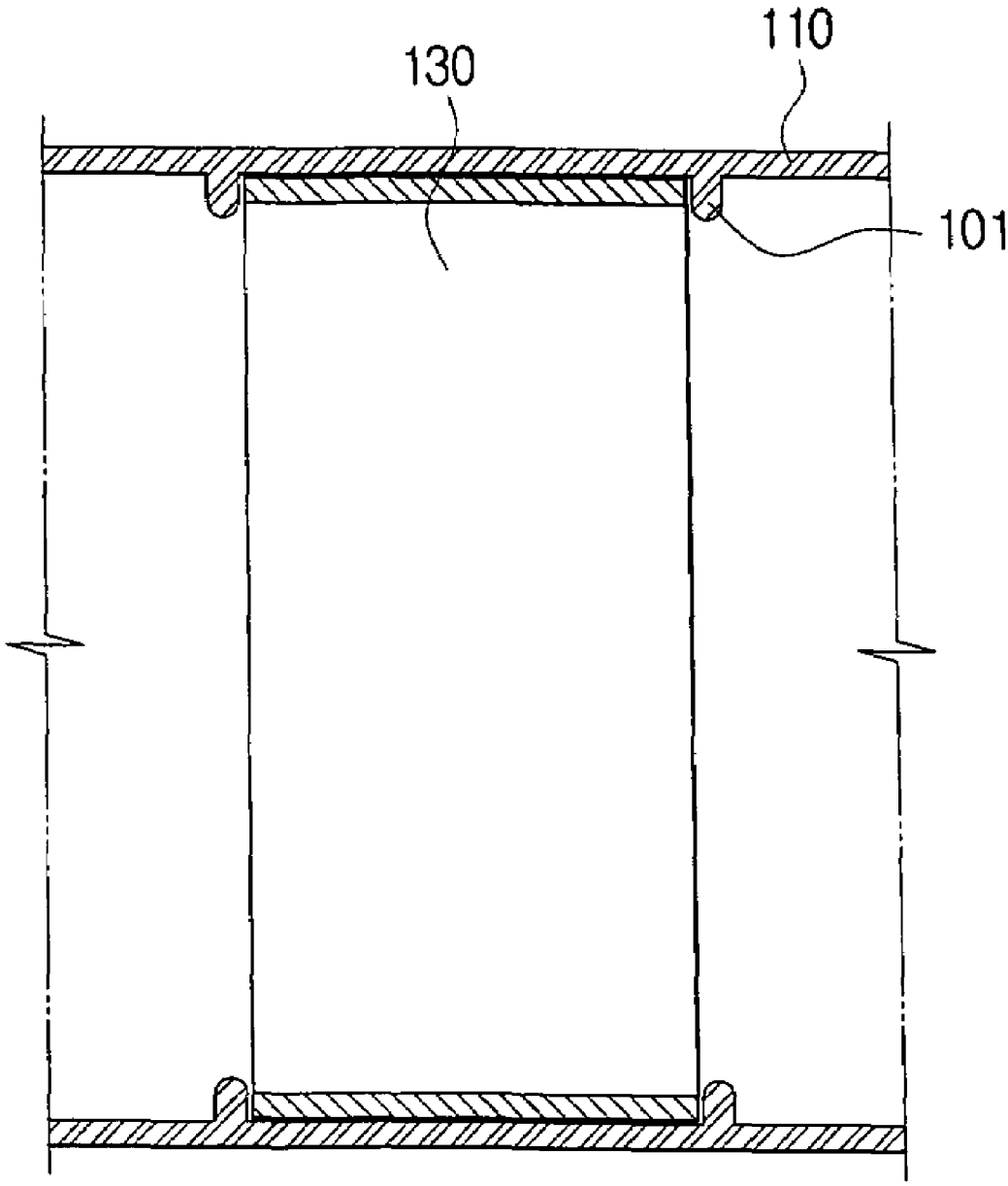
FIG. 4 is a cross-sectional view illustrating a portion of the developer container shown in FIG. 2.

As shown in FIGS. 3 and 4, the inner circumferential surface of the container main body 110 has a plurality of guide parts 101, which guide the rotation of the shutter member 130 such that the shutter member 130 is rotated only at a predetermined position. The guide part 101 is in contact with the both rim portions of the shutter member 130 to retain the shutter member 130, so the rotation position of the shutter member 130 is fixed axially with respect to the axis of the container main body 110. This provides smooth intermittent opening of the developer outlet 112 by the shutter member 130.

In accordance with the present invention as described above, the developer container is installed in the image forming apparatus, and the developer outlet is not kept open afterwards but is opened intermittently. Therefore, since it is possible to control dispensing of the developer in the developer container being supplied to the developing cartridge developer intermittently, an oversupply of the developer to the developing cartridge can be prevented.

In addition, the blockage of the developer conveying passage including the developer inlet of the developing cartridge due to the oversupply of the developer can be prevented. Accordingly, failures or malfunctions of the image forming apparatus can be prevented, thus improving reliability thereof.

The foregoing embodiment and advantages are merely exemplary and are not to be construed as limiting the present invention. The present teaching can be readily applied to other types of embodiments. Also, the description of the embodiments of the present invention is intended to be illustrative, and not to limit the scope of the claims, and many alternatives, modifications, and variations will be apparent to those skilled in the art.

What is claimed is:

1. A developer container for an image forming apparatus, comprising:

a container main body for containing a developer therein, the main body having a side with at least one developer outlet formed in the side; and a shutter unit rotatably mounted in the container main body to open the developer outlet intermittently when rotated, the shutter unit being continuously rotatable about an axis to supply the developer at a continuous rate through the developer outlet, a rotatable member positioned within the container main body and shutter unit and engaging an inner surface of the shutter unit to rotate the shutter unit.

2. The developer container according to claim 1, wherein the container main body includes:

an outer circumferential wall in which the developer outlet is formed;

a first side wall; and a second side wall, wherein the first and the second side wall close both ends of the outer circumferential wall.

3. The developer container according to claim 1, wherein the shutter unit comprises:

a shutter member rotatably mounted in the container main body and having at least one opening that cooperates with the developer outlet to open the container intermittently when the shutter member is rotated; and the rotatable member in the container main body to rotate the shutter member.

4. The developer container according to claim 3, wherein the shutter member has a ring shape with a width greater than the width of the developer outlet.

5. The developer container according to claim 3, wherein the shutter member is provided with a linkage protrusion extending inwardly from an inner circumferential surface of the shutter member, the linkage protrusion being engagable with the rotatable member to receive a rotational force and rotate the shutter member.

6. The developer container according to claim 5, wherein the linkage protrusion is formed from the shutter member by cutting a tab and bending the tab inwardly to form the protrusion.

7. The developer container according to claim 6, wherein the linkage protrusion is adjacent to the opening of the shutter member.

8. The developer container according to claim 3, wherein the rotatable member is rotatably connected to both ends of the container main body at end walls thereof, and where the rotatable member includes a bent portion formed in a center portion thereof to contact the shutter member to operate the shutter member.

9. The developer container according to claim 8, further comprising a drive gear on one end of the container main body, connected to the rotatable member and receiving a drive force from an external source.

10. The developer container according to claim 3, further comprising a sealing member for preventing the developer from passing between the container main body and the shutter member.

11. The developer container according to claim 10, wherein the sealing member is made of a sponge material and disposed between an inner circumferential surface of the container main body and an outer circumferential surface of the shutter member.

12. The developer container according to claim 3, wherein the rotatable member has an agitator rotatably mounted in the container main body to agitate the developer and to operate the shutter member.

13. A developer container for an image forming apparatus comprising a container main body for containing a developer therein, the main body having a side with at least one developer outlet formed in the side;

a shutter unit rotatably mounted in the container main body to open the developer outlet intermittently when rotated; and a rotatable agitator extending axially through the main body, the agitator having an arm extending radially outward to engage the shutter unit to open and close the outlet in the main body.

14. The developer container according to claim 13, wherein the shutter unit comprises:

a cylindrical shutter member concentric with the main body and having at least one opening to align with the outlet of the main body by rotation of the shutter member within the main body, the shutter member having a protrusion adjacent the opening for engaging the arm of the agitator.

15. The developer container according to claim 14, wherein the main body includes a single outlet and the shutter member includes a plurality of openings whereby rotation of the shutter member intermittently opens the developer outlet.

16. A developer supply device, comprising:

a developing cartridge in an image forming apparatus main body and provided with an image receptor therein and having a developer inlet formed therein; and a developer container in the image forming apparatus main body and having a developer outlet cooperating with the developer inlet, a continuously rotatable shutter unit in the developer container, and a rotatable member in the developer container and engaging an inner surface of the shutter unit to rotate the shutter unit, the developer container intermittently supplying the developer by intermittently opening the developer outlet by the continuous rotation of the shutter member.

17. The developer supply device according to claim 16, wherein the developer container comprises:

a container main body containing developer and having at least one developer outlet formed in one side thereof; and the shutter unit rotatably mounted in the container main body to open the developer outlet intermittently when rotated.

18. The developer supply device according to claim 17, wherein the shutter unit comprises:

a shutter member rotatably mounted in the container main body and having at least one opening cooperating with the developer outlet to open the outlet intermittently when the shutter member is rotated; and the rotatable member in the container main body to rotate the shutter member.

19. The developer supply device according to claim 18, wherein the shutter member has a ring shape with a width greater than a width of the developer outlet.

20. The developer supply device according to claim 18, wherein the shutter member includes a linkage protrusion extending from an inner circumferential surface of the shutter member, the linkage protrusion engaging with the rotatable member to receive a rotational force therefrom.

21. The developer supply device according to claim 20, wherein the linkage protrusion is formed from the shutter member by cutting a tab and bending the tab inwardly to form the protrusion.

22. The developer supply device according to claim 21, wherein the linkage protrusion is formed adjacent the opening of the shutter member.

23. The developer container according to claim 18, wherein the shutter member is rotatable and in contact with an inner circumferential surface of the container main body, and wherein the shutter member includes a plurality of openings formed at a predetermined regular interval.

24. The developer supply device according to claim 18, wherein the rotatable member is rotatably connected to opposite ends of the container main body, and where the rotatable member includes a bent portion formed in a center portion thereof that is brought into contact with the shutter member to operate the shutter member.

25. A developer supply device comprising a developing cartridge in an image forming apparatus main body and provided with an image receptor therein and having a developer inlet formed therein;

a developer container in the image forming apparatus main body and having a main body with a developer outlet cooperating with the developer inlet, the developer container intermittently supplying the developer by intermittently opening the developer outlet;

a shutter unit rotatably mounted in the container main body to open and close the developer outlet intermittently when rotated; and a sealing member for preventing developer from passing between the container main body and the shutter unit.

26. The developer supply device according to claim 25, wherein the sealing member is made of a sponge material and disposed between an inner circumferential surface of the container main body and an outer circumferential surface of the shutter member.

27. The developer supply device according to claim 18, wherein the rotatable member has an agitator rotatably positioned in the container main body to agitate the developer and to operate the shutter member.

28. The developer supply device according to claim 18, further comprising a power transmission unit for transmitting a force to the rotatable member in the developing cartridge.

29. The developer supply device according to claim 18, further comprising a drive gear at one end of the container main body, and connected to the rotatable member for receiving a rotating force from an external source.

30. An image forming apparatus, comprising:

an image forming apparatus main body;

a developing cartridge installed in the image forming apparatus main body and having an image receptor installed therein and a developer inlet formed therein;

a transfer roller rotating in contact with the image receptor to transfer an image formed on the image receptor to a printing medium; and a developer container in the image forming apparatus main body and having a developer outlet cooperating with the developer inlet, a continuously rotating shutter unit in the developer container, and a rotatable member in the developer container and engaging an inner surface of the shutter unit to rotate the shutter unit, the developer container intermittently supplying the developer by intermittently opening the developer outlet by the continuous rotation of the shutter member.

31. The image forming apparatus according to claim 30, wherein the developer container includes:

a container main body containing a developer and having at least one developer outlet formed in one side thereof; and a shutter unit rotatably mounted in the container main body to open the developer outlet intermittently when being rotated.

32. The image forming apparatus according to claim 31, wherein the shutter unit comprises:

a shutter member rotatably mounted in the container main body and having at least one opening cooperating with the developer outlet to open the outlet intermittently when the shutter member is rotated; and the rotatable member in the container main body to rotate the shutter member.

33. The image forming apparatus according to claim 32, further comprising a drive gear on one end of the container main body, and connected to the rotatable member for receiving a rotating force from an external source.

34. The image forming apparatus according to claim 33, further comprising a power transmission unit for transmitting a force to the drive gear in the developing cartridge and where the power transmission unit is operatively connected to the drive gear on the container main body and the developing cartridge.

35. The image forming apparatus according to claim 32, further comprising a sealing member for preventing the developer from passing between the container main body and the shutter member.

* * * * *